US005595457A

United States Patent [19]

Stucks

[11] Patent Number: 5,595,457

[45] Date of Patent: Jan. 21, 1997

[54] STORM DRAINAGE UNDERFLOW DAM UNIT

[76] Inventor: Mark A. Stucks, 3058 Trailwood East, Burleson, Tex. 76028

[21] Appl. No.: 404,050

[22] Filed: Mar. 14, 1995

[51] Int. Cl.[6] ..... E02B 7/00

[52] U.S. Cl. ..... 405/87; 405/107

[58] Field of Search ..... 405/80, 87, 88, 405/89, 90, 107, 108, 127

[56] References Cited

U.S. PATENT DOCUMENTS

| | | | |
|---|---|---|---|
| 95,089 | 9/1869 | Conley . | |
| 492,704 | 2/1893 | Anderton . | |
| 1,206,938 | 12/1916 | Stimmel et al. . | |
| 1,843,329 | 2/1932 | Lathrop | 210/154 |
| 2,337,859 | 12/1943 | Stuller | 210/3 |
| 3,212,268 | 10/1965 | Ortega | 61/28 |
| 3,815,742 | 6/1974 | Dubouchet | 210/83 |
| 4,000,618 | 1/1977 | Stovall | 61/1 F |
| 4,277,334 | 7/1981 | Ruidisch et al. | 210/154 |

FOREIGN PATENT DOCUMENTS

| | | | |
|---|---|---|---|
| 3612374 | 10/1987 | Germany | 405/80 |
| 2096219 | 10/1982 | United Kingdom | 405/87 |

*Primary Examiner*—William P. Neuder
*Attorney, Agent, or Firm*—Guy V. Manning

[57] ABSTRACT

An underflow dam unit provides a barrier to pollutants floating in runoff water which otherwise finds its way into storm drains and streams. The underflow dam unit includes a dam disposed between limiting sidewalls, and a baffle spanning between the sidewalls above the dam. The baffle's lower limit extends below the height of the dam, forming a weir channel between the baffle and the dam. Floating pollutants become trapped against the baffle while hydraulic pressure allows subsurface stream water to flow through the weir channel and over the dam. In one embodiment, a plurality of portable emergency dam units may be bolted together and installed through a temporary dirt levee built across a flowing stream or ditch to capture pollutants spilled upstream. In another embodiment, the conventional curb-level inlet to a storm sewer catch basin is replaced by a surface grate which drops runoff water into a chamber buried adjacent the catch basin. The chamber includes a dam disposed beneath another opening leading into the catch basin. A baffle disposed over the dam forms a weir channel, and the baffle may be adjustable for peak flow rates. Means to suppress churning of water pooling in the chamber by incoming runoff may be provided below the inlet grate, and access means to the chamber interior allows for siphoning off trapped pollutants and for adjusting the baffles.

32 Claims, 7 Drawing Sheets

STORM DRAINAGE UNDERFLOW DAM UNIT

BACKGROUND OF THE INVENTION

1. Field of the Invention

This invention relates to improvements to methods and apparatus for capturing floating fluid pollutants spilled into streets, parking lots and streams. More particularly, this invention relates to an underflow dam unit which traps floating pollutants either before or after they escape into a ditch or stream.

2. Description of Related Art

Recent amendments to the federal Clean Water Act and other environmental laws emphasize increased control of non-point source emissions, particularly for street and parking lot runoff tainted by vehicles. Currently parking lots and streets have been equipped with catch basins strategically located to collect runoff and deliver it to open ditches or municipal storm sewer systems, with no accommodation for entrapping pollution before it enters the sewer. Responsibility for control of such emissions, however, more and more is being placed upon property owners and engineers designing runoff systems. A need exists for a cost effective way to capture pollutants at such non-point source situations before they enter the storm sewer systems.

Particular to electric utilities is the need to recapture transformer oil spilled in substations and from oil-filled devices installed on distribution lines. As commonly is done in refinery tank farms, substations increasingly are built with levee systems to trap oil from large power transformers and other oil-filled equipment. Levee systems are undesirable in utility substations, however, because maintenance vehicles frequently must have unobstructed access to power equipment, and levees get in the way. Further, levees may be damaged by the power vehicles and tend to crack on their own without regular maintenance. A need exists for a better way to entrap oil spilled in such installations.

Regardless of the source of pollutants, spills escaping into nearby ditches or streams must be reclaimed. A common way of doing so is to build a temporary levee or embankment across the stream. While water pools behind the levee, piping is buried through the levee with its inlet end below the water surface. The piping allows subsurface water to escape downstream while holding back most of the floating pollution. Such an installation is depicted in FIG. 4. The major disadvantages of such systems include the delay typically required for construction, acquisition of appropriate and adequate piping for each unique installation, and the need for large levees to retain the pollution during the delay. A need exists for an improved system for emergency spill control.

SUMMARY OF THE INVENTION

Accordingly, it is an object of this invention to provide a modular underflow dam unit which may be deployed in emergency cleanup efforts.

It is another object of this invention to provide an emergency modular underflow dam unit which is easily portable and quickly may be deployed.

It is another object of this invention to provide a plurality of modular underflow dam units which easily may be ganged together for increased stream flow capacity.

It is yet another object of this invention to provide a modular underflow dam which may be adapted to permanent installations in parking lots and streets.

It is yet another object of this invention to provide an improved catch basin for storm sewer systems which can trap floating pollutants in rain water runoff and prevent them from escaping into the storm sewer system.

The foregoing and other objects of this invention are achieved by providing an underflow dam unit which provides a barrier to pollutants floating in runoff water which otherwise finds its way into storm drains and streams. The underflow dam unit includes a dam disposed between limiting sidewalls, and a baffle spanning between the sidewalls above the dam. The baffle's lower limit extends below the height of the dam, forming a weir channel between the baffle and the dam. Floating pollutants become trapped against the baffle while hydraulic pressure allows subsurface stream water to flow through the weir channel and over the dam. In one embodiment, a plurality of portable emergency dam units may be bolted together and installed through a temporary dirt levee built across a flowing stream or ditch to capture pollutants spilled upstream. In another embodiment, the conventional curb-level inlet to a storm sewer catch basin is replaced by a surface grate which drops runoff water into a chamber buried adjacent the catch basin. The chamber includes a dam disposed beneath another opening leading into the catch basin. A baffle disposed over the dam forms a weir channel, and the baffle may be adjustable for peak flow rates. Means to suppress churning of water pooling in the chamber by incoming runoff may be provided below the inlet grate, and access means to the chamber interior allows for siphoning off trapped pollutants and for adjusting the baffles.

BRIEF DESCRIPTION OF THE DRAWINGS

The novel features believed characteristic of the present invention are set forth in the appended claims. The invention itself, however, as well as a preferred mode of use and further objects and advantages thereof, will best be understood by reference to the following detailed description of an illustrative embodiment when read in conjunction with the accompanying drawings, wherein:

DETAILED DESCRIPTION OF A PREFERRED EMBODIMENT

Figure 1:
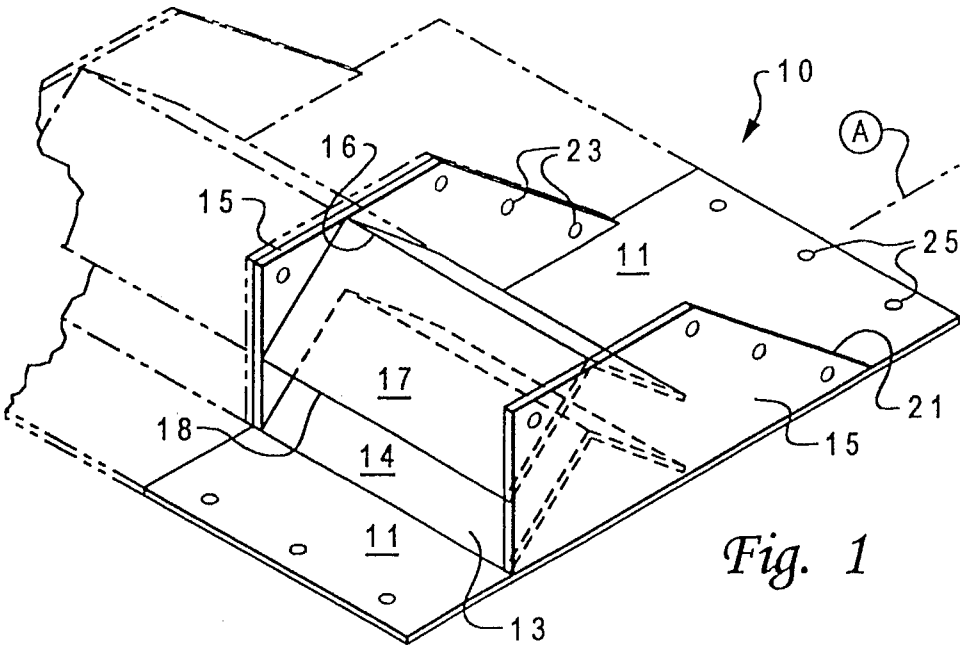
FIG. 1 depicts in perspective one embodiment of the underflow dam invention, with an adjacent unit shown in phantom.
Figure 2:
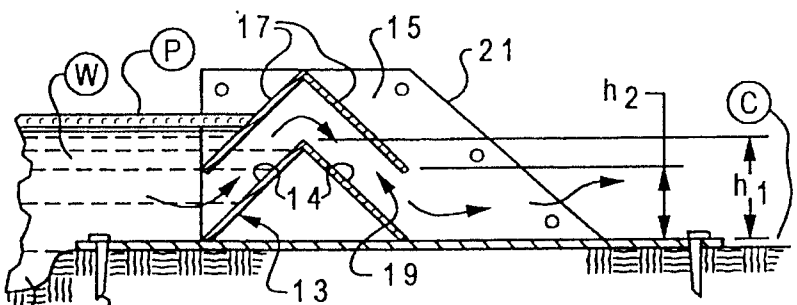
FIG. 2 shows a right side elevation of the underflow dam of FIG. 1 installed in a stream bed.
Figure 3:
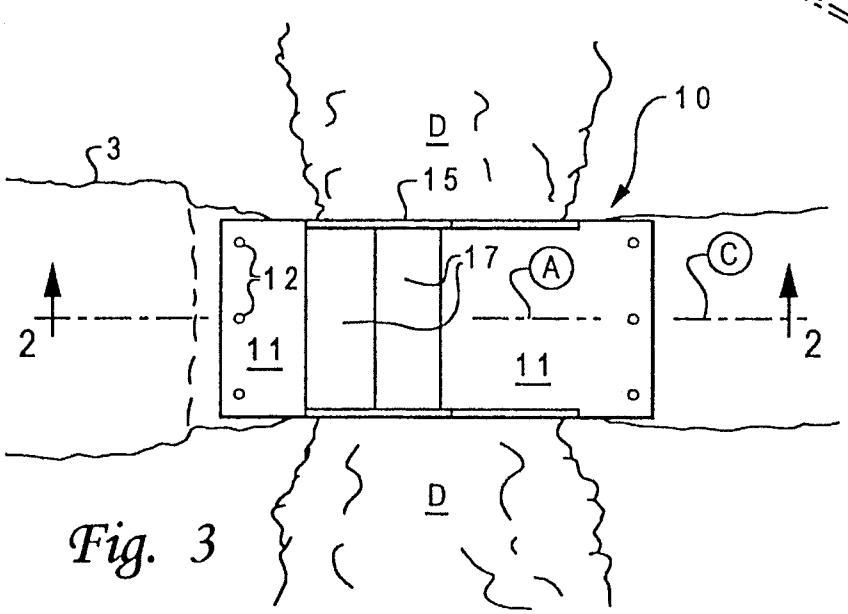
FIG. 3 shows a plan view of the underflow dam of FIG. 1, including an adjacent levee on either side thereof.
Figure 4:
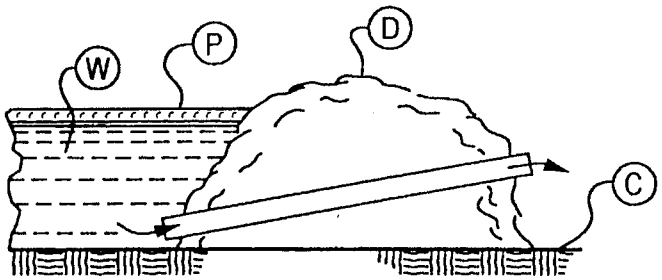
Fig. 4 Prior Art
FIG. 4 details in cross section a prior art method of practicing the invention depicted in FIGS. 1–3.

With reference now to the figures, and in particular to FIGS. 1–3, a modular, prefabricated, emergency underflow dam unit 10 has a rectangular, flat base 11 with a longitudinal axis A adapted to be aligned with the flow line C of a stream (FIG. 3). Parallel the longitudinal axis on each side of base 11 are vertical sidewalls 15 between which rises dam 13. Dam 13 comprises inclined faces 14 meeting at their upper edges to form a peak having a height $h_1$ above base 11, the faces being united with base 11 at their lower edges. Though this arrangement forms a profile having a triangular cross section, one having ordinary skill in the art will recognize that other profiles, such as a trapezoidal cross section (not shown), would serve equally well.

Suspended directly above dam 13 between sidewalls 15 is a means of skimming floating pollutants P from the surface of water W pooling against underflow dam unit 10 as depicted in FIG. 2. The skimmer means depicted comprises flat baffles 17 meeting at their upper edges and angling downward toward base 11 substantially parallel to faces 14 of dam 13. Lower limit 18 of baffles 17 stops at height $h_2$ above base 11, which height is below height $h_1$ of dam 13. In concert with dam 11, the skimmer means creates weir channel 19 between baffles 17 and dam faces 14 through which water W may flow.

Water pooling against underflow dam unit 10 will not flow over dam 13 until it reaches a depth of $h_1$. Once the water surface reaches $h_1$, increased depth creates hydraulic head pressure which forces subsurface water through weir channel 19 and over dam 13. Before water W reaches depth $h_1$, however, lower limit 18 of baffles 17 breaks the water's surface. When water W is $h_1$ deep, baffle 17 extends below the surface a depth of $h_1$–$h_2$. Baffle 17 therefore skims a layer of floating pollutants $h_1$–$h_2$ thick and prevents them from flowing through weir channel 19. If the pollution layer is deeper than $h_1$–$h_2$, of course, some pollutants could escape. Further, a small amount of a layer of any thickness will escape when the water initially rises between baffle 17 and face 14. Separation between baffles 17 and face 14 controls the amount of floating pollution escaping over dam 13 as well as the flow capacity of dam unit 10. Contrasted with the trapped pollution, that lost from the initial rise of water W is de minimis.

In use, underflow dam unit 10 is installed at the flow line C of the stream so that no water can escape beneath base 11. Pollution-absorbent sheets may be laid down beneath base 11 to better seat it in the stream bottom. Anchor holes 25 and pins 12 disposed on either end of base 11 create anchor means for anchoring dam unit 10 in place against the overturning force of water W pressing against faces 14 and baffles 17. Alternately, or additionally, sandbags or other weights (not shown) could be placed on one or more ends of base 11 to achieve the desired anchoring and stability.

FIG. 2 also depicts pit 3 immediately upstream of dam unit 10 across flow line C of the stream. When allowed to settle, floating pollutants will drift to the surface of water W and float in a separate layer. If churned, however, most pollutants, and particularly oily ones, will not settle as readily, resulting in a thicker pollution layer. Pit 3 slows water W as it approaches dam unit 10 to suppress churning of the surface of the water. Material excavated from pit 3 also may be used to build levee D.

FIG. 1 depicts in phantom multiple underflow dam units 10 disposed adjacent to each other. Bolt holes 23 in sidewalls 15 comprise means of coupling multiple underflow dam units side-by-side (FIG. 1) between dirt embankments D on either side of the stream (FIG. 3). By coupling multiple units 10 together, the finite flow capacity of the resulting installation may be increased in increments of single units 10 as needed to accommodate the peak flow of the stream.

Emergency dam unit 10 is bi-directional and may be installed to meet flow from either direction. Brace 21 may be provided, however, to reinforce resistance of sidewalls 15 to overturning moment pressures from water W. If such pressures are not of concern, of course, brace 21 may be omitted or could be fabricated to be optional during installation (not shown). When provided as shown in the figures, however, brace 21 creates a convenient place for coupling together multiple dam units 10 as discussed above. One having ordinary skill in the art will recognize that brace 21 may be a triangular extension of sidewalls 15 as depicted, or it may be a single or multiple members (not shown) extending between sidewall 15 and base 11. Likewise, braces 21 could be provided on both the upstream and downstream sides (not shown) of sidewalls 15 or eliminated altogether without departing from the spirit and scope of the present invention.

In operation, emergency underflow dam units 10 are transported to the site of a spill and a number of them appropriate to the stream size are coupled together. Mastic sealant (not shown) may be applied to the outer surfaces of sidewalls 15 to form a sealed union with the adjacent dam unit 10. Pit 3 may be dug into the flow line of the stream immediately upstream of the installation site of dam unit 10. Excavated materials from pit 3 then could be used to build levee embankment D immediately downstream of pit 3, leaving a narrow gap at the flow line of the stream. Absorbent sheets (not shown) may be laid down in the gap better to seal dam unit 10 to the stream bottom. Dam unit 10 then is set atop the sheets and anchored in place. Backfill against sidewalls 15 of additional dirt or other materials on hand creates a water-tight seal between levee D and dam unit 10, causing water to begin pooling upstream. As soon as water W behind dam unit 10 reaches a depth $h_1$, subsurface water begins to flow downstream while oil or other floating pollutants are trapped behind baffles 17.

Emergency underflow dam units 10 preferably are fabricated from plate steel. Such material provides maximum strength within acceptable weight limits. One such unit weighs approximately 120 pounds for a unit having a flow capacity of approximately two (2 cfs) cubic feet per second at a head of five and one fourth (5.25 in) inches. Such a unit can be carried to an emergency site by two able-bodied men without the need for cranes or other heavy equipment. Welded steel provides sufficient integrity to prevent leakage of trapped pollutants through the barriers. One having ordinary skill in the art will recognize that dam units 10 might be fabricated from other lighter weight materials with similar integrity, such as cross-linked polyethylene or wood, which would be even more suitable for easy transportation.

Figure 5B:
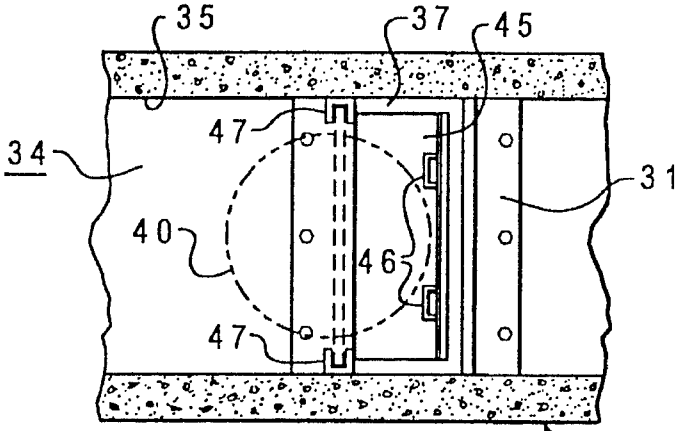
FIGS. 5A–5C depict in cross section another embodiment of the underflow dam invention installed in a box culvert.
Figure 5A:
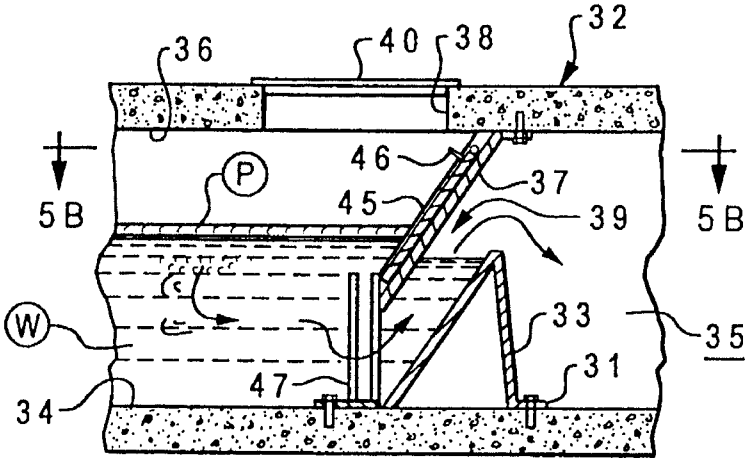
Figure 5C:
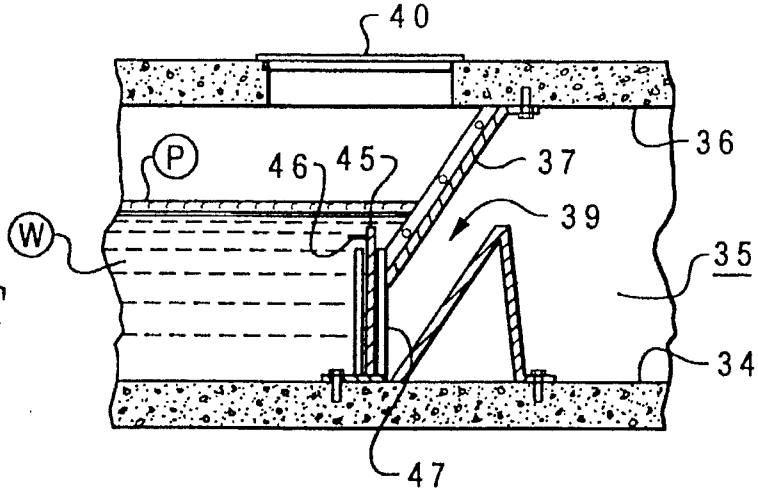
Figures 6, 10:
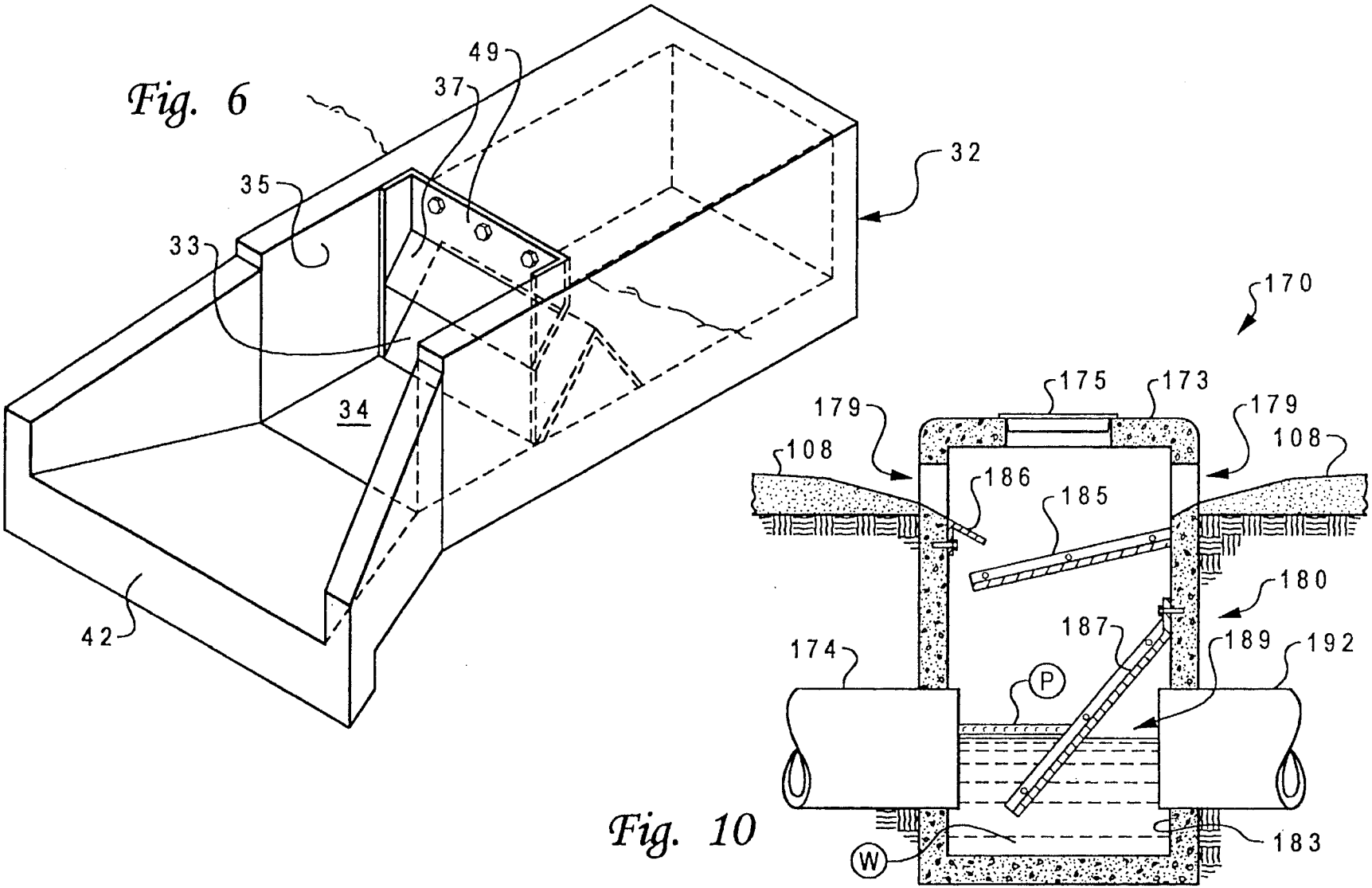
FIG. 6 depicts in perspective a variation on the embodiment shown in FIGS. 5A–5C wherein the box culvert is open at the top near a headwall inlet.
FIG. 10 depicts in elevational section view a modified catch basin incorporating yet another embodiment of the present invention.

FIGS. 5A–5C and 6 depict another embodiment of the present invention wherein underflow dam unit 30 is installed in box culvert 32. Open drainage ditches commonly feed through a headwall 42 (FIG. 6) into culverts which are part of a buried storm sewer system. As depicted in FIG. 6, dam unit 30 may be installed in the open portion of culvert 32 between the embankment and headwall 42. Alternately, as shown in FIGS. 5A–5C, dam unit 30 may be located in the closed portion of box culvert 32 immediately downstream of some access thereto such as manhole 40.

Dam unit 30 includes dam 33 rising from floor 34 of box culvert 32, and baffle 37 is suspended above the upstream face of dam 33. Dam 33 is anchored to the floor 34 of culvert 32 by appropriate anchor means. As depicted, the anchor means employs star-drilled anchor bolts penetrating through horizontal flanges 31 projecting forward and backward from dam 33. Baffle 37 is mounted to sidewalls 35 of culvert 32 by mounting flanges 41 and may also be star-drilled and pinned to ceiling 36 (FIG. 5B) of culvert 32 by ceiling flange 43. Where installed in an open-topped culvert 32, ceiling flange 43 may be replaced by header 49 extending upward from baffle 37 to the top of culvert 32 (FIG. 6), or baffle 37 simply may be long enough to reach the top (not shown). Dam unit 30 operates in similar fashion as that discussed above for emergency dam unit 10. Weir channel 39 formed between baffle 37 and dam 33 permits water hydraulically to escape while baffle 37 retains floating pollutants.

FIGS. 5A–5C also depict another optional feature of permanent installations which are unnecessary for the emergency installations of dam unit 10. Channels 47 are shown mounted vertically to sidewalls 35 of culvert 32 immediately upstream of dam unit 30. Door 45, shown stored and resting on flange 37, alternately may be kept on emergency vehicles and employed when needed. Door 45 cooperates with channels 47 when inserted therein from the top (FIG. 5C) to provide a means of closing off weir channel 39 to stop altogether flow of fluids therethrough. Lower limit 38 of baffle 37 supports door 45 against pressure from fluids pooling upstream. Door 45 may be as simple as a piece of plywood cut to fit channels 47, or it may be as durable as plate steel and bear one or more handles 46 for manipulating door 45. One having ordinary skill in the art will recognize that this door 45 and channel 47 feature may be added to any of the embodiments of the underflow dam unit described herein, including the emergency dam unit 10.

Turning now to FIGS. 7–9C, yet another embodiment of the present invention is depicted for permanent installations with storm sewer systems. Modular dam unit 110 comprises a substantially rectangular chamber buried adjacent conventional catch basin 101 typically placed along streets and around the perimeter of parking lots. Catch basin 101 comprises a vertically disposed cylinder (shown with rectangular cross section) astraddle buried culvert 107 which usually leads to a storm sewer system. Curb 104 and gutter 106 conventionally direct rain runoff through curb inlet 109 into the interior of catch basin 101 where it pools on the bottom and enters culverts 107. Access to the interior of catch basin 101 usually is available by way of manhole 105 through top 103.

Figure 7:
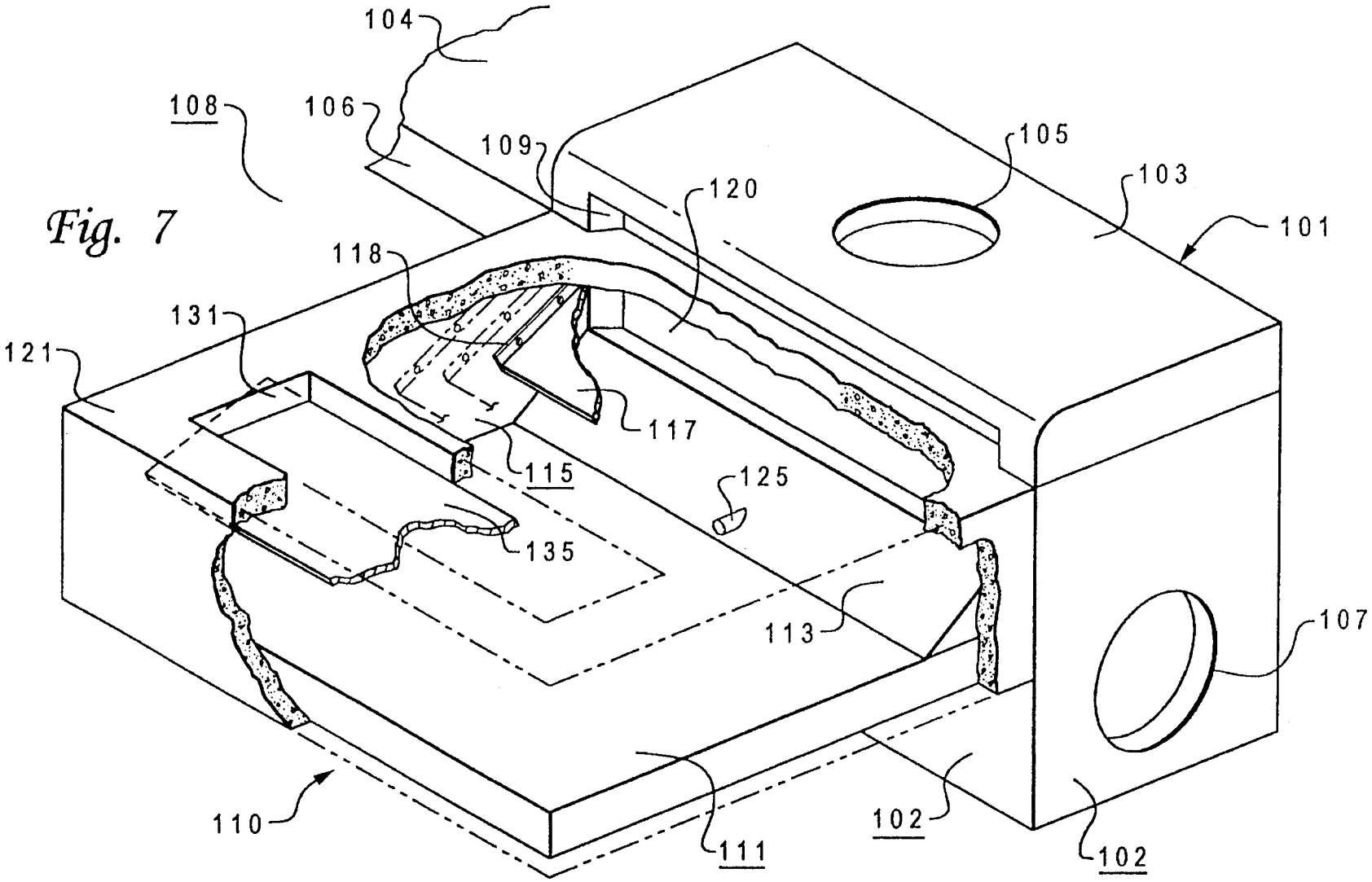
FIG. 7 shows in perspective another embodiment of the underflow dam invention, this embodiment being an adaptation of a conventional catch basin used in storm sewer systems.
Figure 8A:
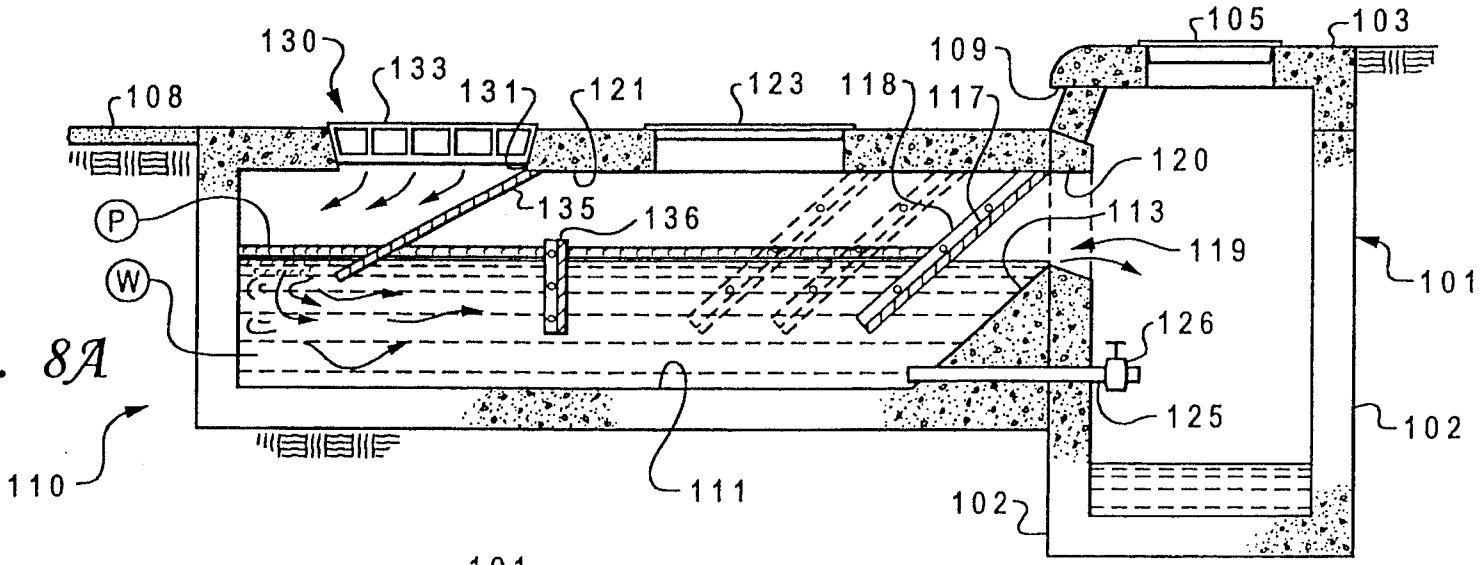
FIG. 8A depicts in right side elevational cross section the embodiment shown in FIG. 7.

Dam unit 110 of FIG. 7 is shown installed adjacent catch basin 101 below inlet 109. Inlet 109 is sealed to prevent runoff water from bypassing dam unit 110. Runoff water W enters dam unit 110 through surface drop 130 comprising aperture 131 covered by grate 133 of conventional design. Though shown in the figures as substantially flush with pavement 108, one having ordinary skill in the art will recognize that dam unit 110 may be disposed at any vertical displacement below pavement 108, limited only by the depth of catch basin 101, and typically will be at least eighteen (18 in.) inches below the surface of pavement 108. In such cases, vertical extensions (not shown) of manhole 123 and aperture 131 (FIGS. 8A, 8B) will be required so that manhole 123 and grate 133 would be flush with pavement 108.

As depicted in FIG. 7, dam unit 110 includes floor 111, substantially vertical perimeter walls 115 and ceiling 121. Juxtaposed to catch basin 101 is dam 113 disposed beneath aperture 120 through catch basin wall 102 into the interior of catch basin 101. Baffle 117 is suspended above dam 113 to create weir channel 119 leading to aperture 120. Baffle 117 abuts sidewalls 115 and ceiling 121 of dam unit 110 to prevent escape of floating pollutants over the top of baffle 117. Supported on sidewalls 115 by end flanges 118, baffle 117 may be relocated to one of a plurality of alternate positions, to increase flow capacity through weir channel 119. Manhole 123 provides access into dam unit 110 for changing positions of baffle 117 and for periodic syphoning off of trapped pollutants. Alternately, in lieu of manhole 123, grate 133 over runoff inlet 131 usually is removable and may serve for access to the interior of dam unit 110. Drain 125 penetrates dam 113 and catch basin side 102 to permit draining off of water W trapped behind dam 113. Valve 126 inside catch basin 101 is accessible through manhole 105.

Figure 8B:
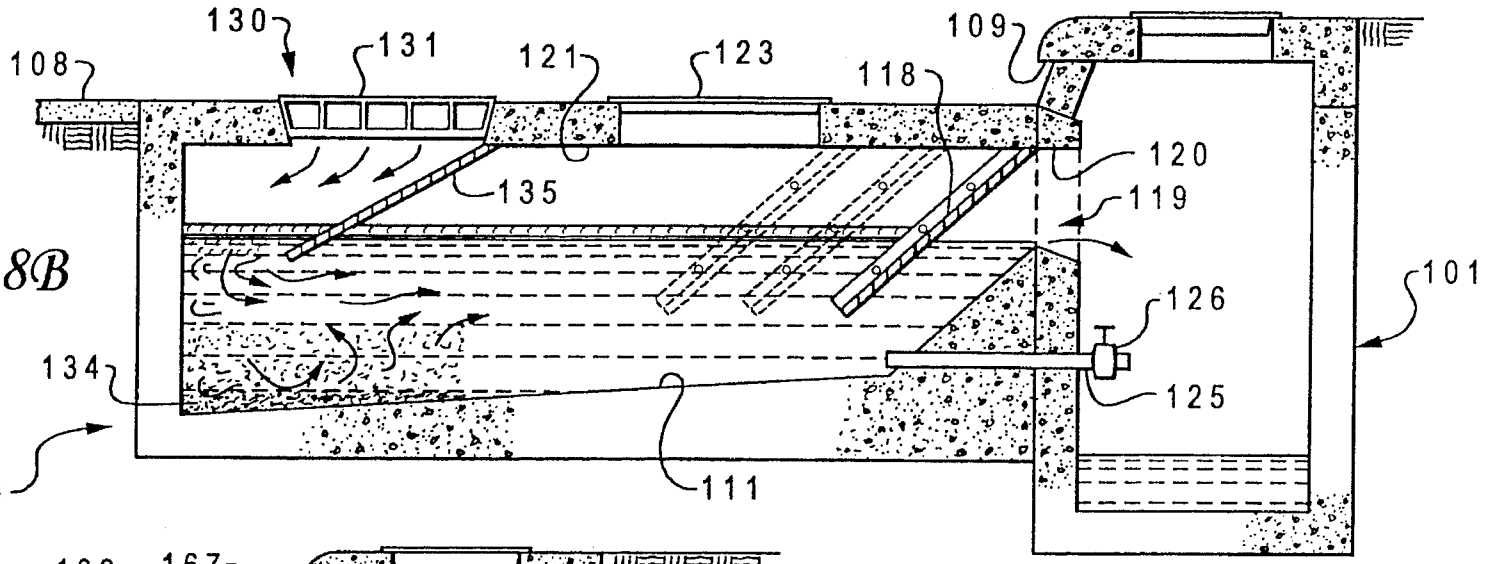
FIG. 8B shows in right side elevational cross section a variation of the embodiment depicted in FIGS. 7 and 8A.

Runoff water from pavement 108 falls through grate 133 and onto floor 111 where it pools, allowing pollutants P to settle into a layer on the surface. Because it is important to minimize the depth of this pollutant P layer, means for suppressing churning of the pooling water W bearing pollutants P may be provided within dam unit 110. As seen in FIGS. 7–8B, the falling runoff water encounters splash shield 135 which intercepts the falling runoff water and slows it to suppress churning when it falls into water W already pooling inside dam unit 110.

Additionally, vertically disposed between inlet 131 and dam 113, stabilizer 136 may span between sidewalls 115 to further calm the surface of water W. Stabilizer 136 has a lower limit below the lower edge of baffle 117 and an upper limit above the top of aperture 120, but it does not reach floor 111 or ceiling 121. Stabilizer 136 may be solid sheet metal or it may comprise a grating with a plurality of apertures (not shown) for permitting water W to flow through stabilizer 136.

FIG. 8B depicts yet another means of suppressing churning of pooling water W. Floor 111 in FIG. 8B is shown sloping away from dam 113 and toward inlet 131. Because of its incline, floor 111 will cause deep turbulence in water W to be turned more sharply back on itself, tending to confine such turbulence to the end of dam unit 113 away from baffle 117 and weir channel 119. This effect maximizes the distance between the churned portion of pooling water W and thereby maximizes the horizontal length of the settled pollution layer P. Further, silt carried into dam unit 110 by runoff water can be expected to build up beneath inlet 131, adding mass to the water pooling there and further suppressing churning. One having ordinary skill in the art will recognize that this tilted floor 111 could be a feature of any of the permanent installations depicted in FIGS. 7–10 without departing from the spirit and scope of the present invention.

Though a single unit is depicted in FIGS. 7–8B, one having ordinary skill in the art will recognize that a plurality of such units could feed into a single catch basin 101, either side-by-side adjacent one wall 102, or feeding into other walls 102 around the perimeter of catch basin 101. Further, one having ordinary skill in the art will recognize that aperture 120 into catch basin 101 could penetrate through roof 103 (not shown) of catch basin 101 instead of wall(s)

102. In such case, dam unit 110 would be installed over the top of catch basin 101, and water leaving weir channel 119 would fall vertically downward through aperture 120 and into catch basin 101.

Figure 9A:
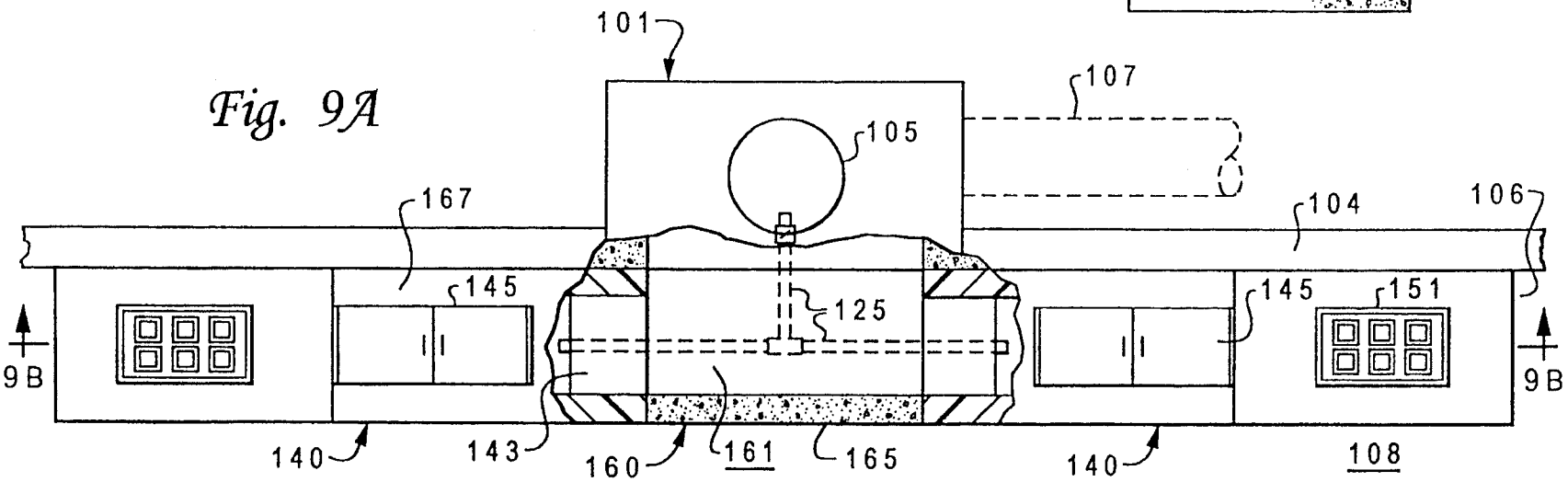
FIGS. 9A–9C depict in plan view, in front partial sectional elevation and in right side sectional elevation views a variation on the embodiment shown in FIGS. 7 and 8.
Figure 9C:
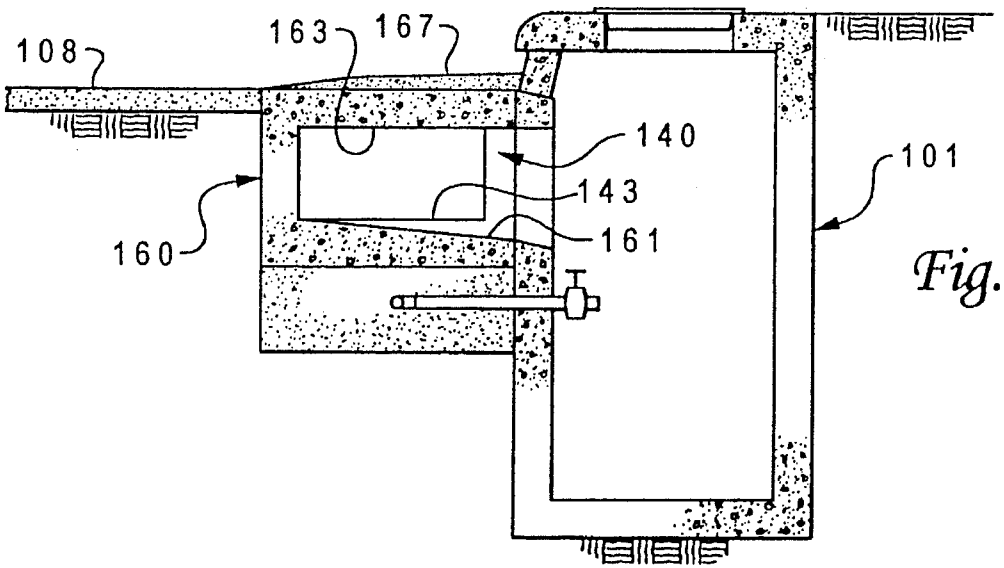
Figure 9B:
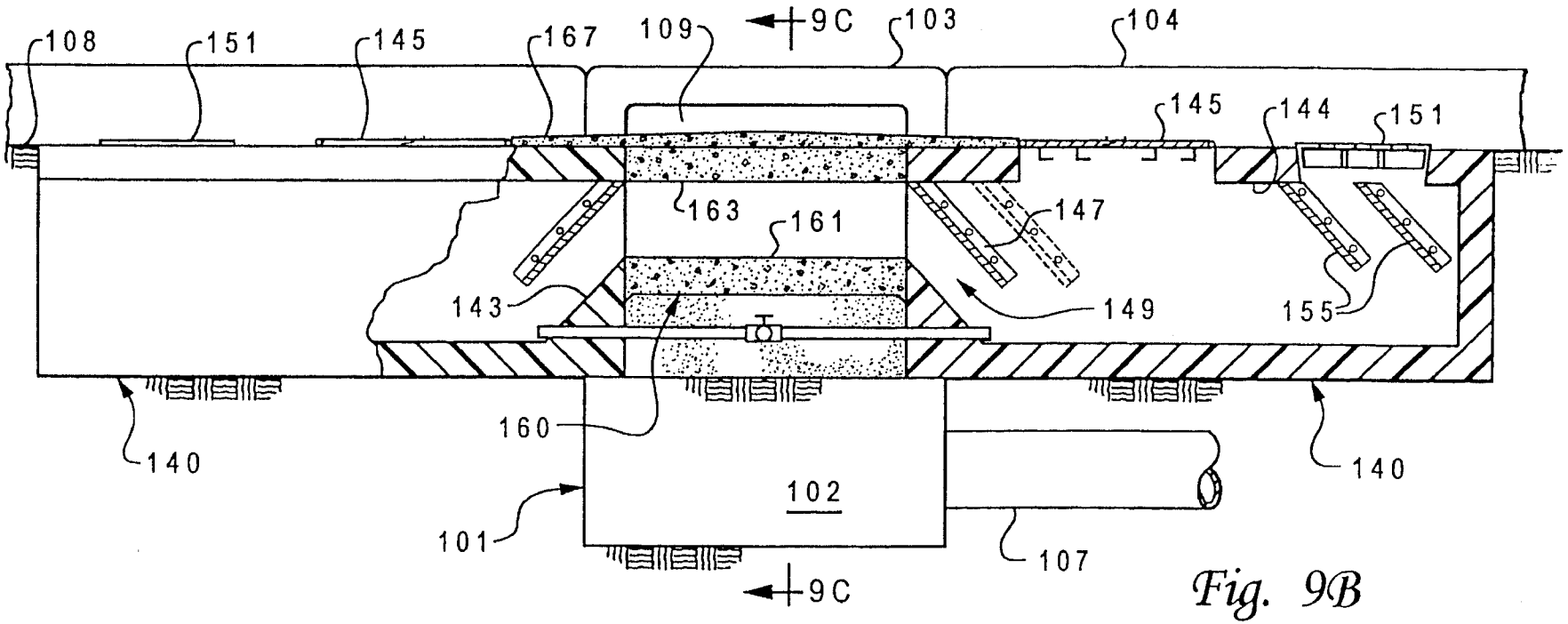

As depicted in FIGS. 7 and 8, dam unit 110 protrudes into the street or parking lot, and may be vulnerable to damage from vehicular traffic passing over pavement 108, particularly if it is close to the pavement surface. As shown in FIGS. 9A–9C, dam units 140 may be installed substantially beneath gutter 106. In this configuration, they protrude far less beneath pavement 108 than dam unit 110.

Dam unit 140 also may be installed in pairs feeding toward each other (FIGS. 9A, 9B) and sharing a common collector means 160 for feeding into catch basin 101. The collector means 160 depicted comprises a boxed chamber having deck 161 sloping toward aperture 120 in wall 102 of catch basin 101. Drain pipes 125 penetrating dams 143 feed into catch basin 101 as discussed above. Dams 143 abut deck 161 and weir channels 149 of dam units 140 feed across dam 143 into collector 160. Roof 163 of collector 160 spans and covers collector 160 between adjacent dam units 140. Grouting 167 may be used to bias runoff away from sealed inlet 109 and toward grate 151. One having ordinary skill in the art will recognize that collector means 160 could instead be a culvert, pipe or other closed channel leading into catch basin 101. Collector means 160 need not be sealed against leakage into the ground since pollutants are trapped before entering collector means 160, but it would have to be closed at the top to prevent runoff water from bypassing dam unit(s) 140 and entering directly into catch basin 101.

As discussed above for FIGS. 7 and 8, baffles 147 create weir channel 149 above dam 113 and also may be adjustable. Access to the interior of dam unit 140 may be provided through trap door 145 or grate 151. FIG. 9B depicts dual splash shields 155 replacing single splash shield 135 of FIGS. 7 and 8. One having ordinary skill in the art will recognize that these variations in splash shield configurations, access means and orientation are within the spirit and scope of the present invention.

FIG. 10 shows an adaptation 170 of catch basin 101 to accomplish the benefits of the present invention. Dam unit 180 comprises baffle 187 installed immediately above the top of discharge culvert 172. Splash shield 185 intercepts falling runoff water from inlet(s) 179 and slows it to suppress churning as discussed above. Baffle 187 creates a skimmer means by attaching to the interior side walls of catch basin 170 to prevent overflow of pollutants P.

In conventional catch basins, the flow line of culvert 172 lies at or near the floor of the catch basin. An explicit dam unit (not shown) may be installed in front of discharge culvert 172 to create weir channel 189 for retrofitting existing catch basins. However, such dam unit would necessarily constrict the flow of culvert 172, because it would have to cover part of culvert 172 to create weir channel 189. Alternately, the same effect may be produced by lowering the floor of catch basin 170, creating ledge 183 below the flow line of discharge culvert 172. Of course, modified catch basin 170 may be installed in this fashion when constructed. In either case, the lower limit of baffle 187 must extend below the flow line of culvert 172, thus creating weir channel 189 without the need for a sloping dam face (as depicted in other embodiments above). As FIG. 10 depicts, multiple surface inlets may feed into catch basin 170, such as in parking lot inlets not confined to the perimeter of large parking areas.

One or more incoming culverts 174 also may feed into catch basin 170, but there likely will be only one discharge culvert 172. Incoming culverts 174 may come from other catch basins or from open ditches through headwalls such as that depicted in FIG. 6. Incoming culverts 174 also may enter catch basin 170 at elevations above the flow line of discharge culvert 172. Baffles 187 would not be appropriate for incoming culverts 174 because such baffles may trap pollutants in culverts 174 and not allow them into catch basin 170 where they can be siphoned through manhole 175. Instead, pollution layer P must be allowed to back up into incoming culverts 174 to the extent they are not contained within catch basin 101.

Most storm sewer systems are not water tight. Since the only concern in such systems is dispersion of accumulated rain runoff, intrusion of groundwater from surrounding strata is of no concern. Likewise, when the runoff is nothing but rain water, no harm arises from leakage into the surrounding strata from the storm sewer system. For trapping pollutants P, however, the key to success of dam units 110, 140 and 180 is prevention of leakage into the surrounding strata. Modular dam units 110 and 140 preferably are fabricated from single-poured, reinforced concrete to create a jointless chamber. Alternately, and as depicted by the symbolic cross-hatching of FIGS. 9A and 9B, dam units 110 and 140 could be made of synthetic materials resistant to anticipated pollutants and impermeable to water. Such materials could include cross-linked polyethylene or fiberglass, or other materials having the characteristics of acceptable strength and greatly reduced weight in contrast to poured concrete.

Dam units 110 and 140 should be sealed with an industrial grade epoxy paint or other suitable sealant to eliminate porosity which might allow pollutants to leach through the concrete walls. Collector means 160 need not be so sealed, however, since pollutants are trapped inside dam units 140 before the effluent runoff water enters weir channel 149. Improved catch basin 170, however, also would need to be sealed.

While the invention has been particularly shown and described with reference to a preferred embodiment, it will be understood by those skilled in the art that various changes in form and detail may be made therein without departing from the spirit and scope of the invention. For example, FIGS. 5A–5C and 6 depict a permanent installation sized for the particular culvert 32 in place. Variable width units (not shown) also may be provided on emergency vehicles for temporary installations in box culverts. Such units may be equipped with sliding extensions (not shown) for dam 33 and baffle 37. Sandbags or other convenient weights resting on flange 31 may hold the temporary dams in place, and risers (not shown) on either end of dam 33 could support baffle 37 without the need to permanently attach baffle 37 to sidewalls 35 and/or ceiling 36. Also, dam units 110 and 140 were discussed above employing inlet grate 133 flush with pavement 108. Other inlet configurations could be employed in place of grate 133, such as a curb inlet (not shown) similar to inlet 109 into catch basin 101. In such case, dam units 110 and 140 could even be installed with their ceilings above pavement 108, as long as their floors remained below pavement 108 so that water would gravity feed into the chamber.

I claim:

1. A portable underflow dam unit comprising a horizontal base having a longitudinal axis extending between opposite ends of the base;

sidewalls extending upward from the base on either side of the longitudinal axis;

a dam extending upward from the base between the sidewalls and having a peak height above the base;

skimmer means spanning between the sidewalls above the dam, the skimmer means having a lower limit below the peak height of the dam, for skimming floating pollutants from the surface of water flowing over the dam;

anchor means for anchoring the base to a flow line of a stream.

2. The underflow dam unit according to claim 1 wherein the dam comprises two planar faces having their upper edges coupled together, the faces diverging downward to the base.

3. The underflow dam unit according to claim 1 wherein the anchor means comprises a plurality of anchor pins adapted to cooperate with holes along opposite ends of the base and to penetrate into the bottom of the stream.

4. The underflow dam unit according to claim 1 wherein each sidewall further comprises coupling means for coupling the sidewall to a sidewall of an adjacent underflow dam unit.

5. The underflow dam unit according to claim 4 wherein the coupling means comprises a plurality of bolts adapted to cooperate with bolt holes disposed at matching positions in each of the sidewalls of adjacent underflow dam units.

6. The underflow dam unit according to claim 1 wherein each sidewall further comprises brace means for bracing the underflow dam unit against force from water pushing against the dam and the skimmer means.

7. The underflow dam according to claim 6 wherein the brace means comprises an extension of each sidewall extending coplanar therewith and generally downward to couple to the base between the dam and the end of the base.

8. A portable underflow dam unit comprising a horizontal base having a longitudinal axis extending between opposite ends of the base;

sidewalls extending upward from the base on either side of the longitudinal axis;

a dam extending upward from the base between the sidewalls and having a peak height above the base;

at least one baffle disposed above the dam and extending downwardly substantially parallel the dam to height above the base below the peak height of the dam; and anchor means for anchoring the base to a flow line of a stream.

9. An underflow dam unit adapted to couple to a conventional catch basin, the catch basin including a top, walls forming a vertical cylinder extending downward from the top to straddle a buried culvert, and one or more inlets for admitting runoff water from the ground surface into the interior of the cylinder and the culvert, the underflow dam unit comprising at least one chamber adjacent the catch basin, the chamber having a floor adjacent one wall of the catch basin;

generally vertical sidewalls disposed around the floor; and a roof forming a ceiling to the chamber;

a dam disposed on the floor of the chamber, the dam having a peak vertically disposed beneath the bottom of an aperture through the adjacent catch basin wall;

skimmer means disposed above the dam adjacent the ceiling and extending downward below the dam peak;

inlet means admitting runoff rain water or other fluids into the chamber;

drain means through the dam for draining stagnated fluids trapped by the dam; and access means for accessing the chamber.

10. The underflow dam unit according to claim 9 wherein the skimmer means comprises a baffle spanning between chamber sidewalls on either side of the dam; and adjustment means for adjusting a separation between the baffle and the dam.

11. The underflow dam unit according to claim 9 wherein the adjustment means comprises at least one mounting flange on each end of the baffle and bearing a plurality of holes; and a plurality of bolts adapted to cooperate with threaded cavities arranged in sets to form mounting positions for the flanges along the chamber walls successively farther from the outlet.

12. The underflow dam unit according to claim 9 wherein the inlet means comprises a grate disposed flush with the ground surface and coupled to an inlet aperture through the roof of the chamber.

13. The underflow dam unit according to claim 9 and further comprising suppression means for suppression of churning of water pooling inside the chamber.

14. The underflow dam unit according to claim 13 wherein the suppression means comprises a splash shield between the inlet means and the floor.

15. The underflow dam unit according to claim 13 and further comprising stabilizer means suspended between the chamber sidewalls above the floor and between the splash shield and the dam for stabilizing and calming turbulence in water and floating pollutants pooling in the chamber.

16. The underflow dam unit according to claim 13 wherein the stabilizer means comprises a splash shield between the inlet means and the floor; and stabilizer means disposed above the floor between the splash shield and the dam for stabilizing the surface of a pollution layer on water pooling in the chamber.

17. The underflow dam unit according to claim 9 and further comprising barrier means adapted to close the weir channel to prevent fluids from exiting the chamber into the catch basin.

18. The dam according to claim 17 wherein the barrier means comprises two channels mounted to the side walls of the chamber juxtaposed the lower limit of the skimmer means; and a door adapted to cooperate with the channels and to seal the weir channel between the lower limit of the skimmer means and the dam.

19. The dam according to claim 9 and further including collector means coupled between the outlet and the aperture in the catch basin wall.

20. The dam according to claim 19 wherein the collector means comprises a concrete housing having a deck aligned with the lip of the outlet and sloping toward the catch basin aperture, the housing further having a roof flush with the ground level.

21. An improved catch basin, the catch basin having a top substantially flush with the ground adjacent a curb, vertical walls forming a cylinder extending into the earth to a buried storm drain culvert, one or more inlets permitting runoff water from the curb to enter the cylinder, and a manhole providing access to the interior of the catch basin, the improvement comprising a dam extending upward from the floor of the catch basin to an opening into the culvert; and a baffle disposed above the dam and extending downward from the wall of the catch basin above the culvert to a level below the top of the dam to form a weir channel between the baffle and the dam.

22. The improved catch basin of claim 21 and further comprising barrier means coupled between the baffle and the dam for creating a barrier to the flow of fluids through the weir channel.

23. The improved catch basin of claim 21 and further comprising suppression means for suppressing churning of water pooling in the bottom of the catch basin.

24. The improved catch basin of claim 23 wherein the suppression means comprises a splash shield disposed above the culvert and in the path of runoff water falling into the cylinder from the inlets.

25. A method of capturing floating pollutants in a stream, the stream having a centerline and a bottom flow line, the method comprising providing a plurality of modular underflow dam units, each having a base having a longitudinal axis;

sidewalls extending upward from the base on opposite sides of the longitudinal axis;

a dam extending upward from the base between the sidewalls to height above the base;

a baffle spanning between the sidewalls above the dam to form a weir channel between the baffle and the dam;

laying a plurality of fluid-absorbent sheets in the stream at its flow line; then anchoring the base of at least one underflow dam unit at the stream flow line atop the fluid-absorbent sheets; then building a levee transverse the stream on both sides of the underflow dam unit, the levee mating with the sidewalls of the underflow dam unit to seal the levee and to prevent stream water from leaking around the underflow dam unit; and periodically siphoning off pollutants floating on the stream water and pooling upstream of the levee and the underflow dam unit.

26. The method of claim 25 and further comprising excavating a pit transverse the stream centerline immediately upstream the underflow dam unit; and then using materials excavated from the pit to build at least part of the levee.

27. The method of claim 25 and further comprising coupling one or more additional underflow dam units side-by-side through the levee whereby the flow capacity of the weir channel approximates the flow of the stream.

28. A method of improving a conventional storm sewer catch basin to entrap pollutants floating on rain water influent the catch basin from nearby pavement, the method comprising providing an underflow dam unit having a floor;

substantially vertical walls around the floor, one of said walls having an outlet;

a roof forming a ceiling to the underflow dam unit;

a dam disposed on the floor of the below the outlet;

a baffle suspended from the ceiling above the dam to form a weir channel between the baffle and the dam;

inlet means for permitting rain water and other fluids to enter the chamber;

drain means for draining stagnated fluids trapped by the dam; and access means for accessing the chamber; then burying the underflow dam unit adjacent the catch basin;

opening an aperture into the catch basin aligned with the outlet;

sealing any catch basin curb inlets to prevent runoff from bypassing the dam unit by entering the catch basin directly from the pavement; and then grading the surface of the pavement to cause runoff water to flow toward the inlet means.

29. A portable underflow dam unit comprising a horizontal base having a longitudinal axis extending between opposite ends of the base;

sidewalls extending upward from the base on either side of the longitudinal axis;

a dam extending upward from the base between the sidewalls and having a peak height above the base;

skimmer means spanning between the sidewalls above the dam, the skimmer means having a lower limit below the peak height of the dam, for skimming floating pollutants from the surface of water flowing over the dam; and stream control means for controlling water and directing it through the dam unit.

30. The underflow dam unit according to claim 29 wherein the stream control means comprises pooling means for pooling water upstream of the dam; and anchor means for anchoring the dam unit whereby the dam unit intercepts a stream of water.

31. The underflow dam unit according to claim 30 wherein the anchor means comprises a plurality of anchor pins adapted to cooperate with holes in the base and to penetrate through the base and into the bottom of a stream whereby the base is anchored to a flow line of the stream of water; and sealing means for preventing stream water from bypassing the dam unit.

32. The underflow dam unit according to claim 31 wherein the sealing means comprises absorbent sheets placed around the outside perimeter of the dam unit whereby stream water is prevented from seeping beneath the base and along the sidewalls.

* * * * *